US012509905B2

(12) United States Patent
Landon et al.

(10) Patent No.: US 12,509,905 B2
(45) Date of Patent: Dec. 30, 2025

(54) GROUND STAKE AND TAG SYSTEM

(71) Applicant: Marking Services Incorporated, Milwaukee, WI (US)

(72) Inventors: Clint Wayne Landon, San Angelo, TX (US); Jeffrey Dickinson, River Hills, WI (US); John Dykstra, Mt. Pleasant, WI (US); Tim Bertram, Racine, WI (US); Terrence Lewandowski, Muskego, WI (US); Andrew Weisensel, Oak Creek, WI (US)

(73) Assignee: Marking Services Incorporated, Milwaukee, WI (US)

( * ) Notice: Subject to any disclaimer, the term of this patent is extended or adjusted under 35 U.S.C. 154(b) by 173 days.

(21) Appl. No.: 18/507,701

(22) Filed: Nov. 13, 2023

(65) Prior Publication Data

US 2025/0154791 A1 May 15, 2025

(51) Int. Cl.

| | |
|---|---|
| ***E04H 15/62*** | (2006.01) |
| ***E04H 13/00*** | (2006.01) |
| ***G06F 16/955*** | (2019.01) |

(52) U.S. Cl.

CPC ..... *E04H 15/62* (2013.01); *E04H 13/003* (2013.01)

(58) Field of Classification Search

CPC ..... E04H 15/62

USPC ..... 135/118; 52/103, 155; 40/645; D21/840

See application file for complete search history.

(56) References Cited

U.S. PATENT DOCUMENTS

| | | | | | |
|---|---|---|---|---|---|
| 1,651,780 | A | * | 12/1927 | Slawson | E04H 13/003 40/124.5 |
| 1,748,584 | A | * | 2/1930 | Pollard | E04H 13/003 40/124.5 |
| 1,822,787 | A | * | 9/1931 | Slawson | G09F 3/206 40/645 |
| 1,997,087 | A | * | 4/1935 | Sisson | E04H 13/003 40/124.5 |
| D164,994 | S | * | 10/1951 | Johannensen | D21/840 |

(Continued)

FOREIGN PATENT DOCUMENTS

| | | | |
|---|---|---|---|
| JP | 2004254642 | A | 9/2004 |
| KR | 102203549 | B1 | 1/2021 |

OTHER PUBLICATIONS

International Search Report and Written Opinion for Application No. PCT/US2024/055509 dated Feb. 18, 2025 (16 pages).

*Primary Examiner* — Robert Canfield
(74) *Attorney, Agent, or Firm* — Michael Best & Friedrich LLP

(57) ABSTRACT

A ground stake includes an elongate body, a face plate at a top end of the elongate body, first and second depth and installation tabs projecting sidewardly and forwardly from first and second edges of the elongate body, the first and second depth and installation tabs each including an upwardly opening slot for receiving a tool to apply force to drive the ground stake. The first and second depth and installation tabs provide a visual indication that the ground stake is adequately driven. A tag system includes the ground stake, a first web server, and a user device for scanning the QR code and linking to the first web server via a local network. The first web server determines a specific web page from the QR code and directs the user device to the specific web page, including web pages from a web browser hosted on a second web server.

20 Claims, 5 Drawing Sheets

(56) References Cited

U.S. PATENT DOCUMENTS

| | | | | | |
|---|---|---|---|---|---|
| 4,027,410 | A * | 6/1977 | Wheeler | G09F 3/206 | 40/645 |
| D246,513 | S * | 11/1977 | Garneau | D10/66 | |
| 4,127,972 | A * | 12/1978 | Reimoser | G01C 15/04 | 52/103 |
| 4,738,060 | A * | 4/1988 | Marthaler | E04H 12/223 | 52/153 |
| 5,044,200 | A * | 9/1991 | Dailey | G09F 7/18 | 52/103 |
| 5,369,902 | A * | 12/1994 | Minster | G09F 3/12 | 248/156 |
| 6,327,804 | B1 * | 12/2001 | Shaw | G09F 3/206 | 40/645 |
| 6,349,514 | B1 | 2/2002 | Adams | | |
| 7,631,447 | B2 | 12/2009 | Morton et al. | | |
| 8,286,379 | B2 * | 10/2012 | Martin | G09F 3/206 | 40/645 |
| 9,330,581 | B2 * | 5/2016 | Zinnbauer | G09F 3/12 | |
| 9,934,702 | B2 * | 4/2018 | Harshman | G09F 3/12 | |
| 2004/0089739 | A1 * | 5/2004 | Corbett | B05B 15/16 | 239/271 |
| 2006/0070313 | A1 * | 4/2006 | Moblo | E04G 17/14 | 52/155 |
| 2009/0071069 | A1 * | 3/2009 | Conde | E04H 12/2215 | 47/33 |
| 2009/0233739 | A1 * | 9/2009 | Minarovic | A63C 19/08 | 473/490 |
| 2011/0146124 | A1 | 6/2011 | Carlson et al. | | |
| 2017/0109621 | A1 * | 4/2017 | Brown | E04H 13/003 | |
| 2017/0130480 | A1 | 5/2017 | Perkins | | |
| 2022/0201941 | A1 | 6/2022 | Ellis et al. | | |

* cited by examiner

GROUND STAKE AND TAG SYSTEM

BACKGROUND

This disclosure relates to ground stakes for displaying tags and a tag system.

SUMMARY

Ground stakes have been used for a variety of purposes, in many cases to hold a rope or similar item in place or as general marker, for example, as point in a land survey. However, ground stakes have typically be designed without additional features and often consist solely of a wood or metal spike-shaped member that is driven in the ground with a hammer, for example, a sledge hammer. The inventors have developed readily installed ground stakes that can be placed at a predetermined ground depth easily and that provides an angled face plate at a top end of the stake for a QR code or similar tag to be easily read by a scanner or camera, for example, a camera in a smart phone.

In one aspect, the arrangement is directed to a ground stake and tag system, wherein the ground stake includes depth and installation tabs that are both used to drive the ground stake into a ground location and to provide a uniform depth for the ground stake.

In another aspect, the arrangement is a ground stake comprising: an elongate body, a face plate at a top end of the elongate body, a first depth and installation tab projecting both sidewardly and forwardly from a first side of the elongate boy and including a first slot opening upwardly for receiving a tool. A second depth and installation tab projects both sidewardly and forwardly from a second side of the elongate body and including a second slot opening upwardly for receiving a took, and a tip at a bottom end of the elongate body for penetrating ground.

Another aspect is directed to a tag system including a ground stake, and further including a first web server connected to a local network, and a smart phone or tablet for scanning a QR code from the ground stake and linking to the first web server via the local network. The first web server determines a specific web page from the QR code and directs the smart phone or tablet to the specific web page.

DETAILED DESCRIPTION

Figure 1:
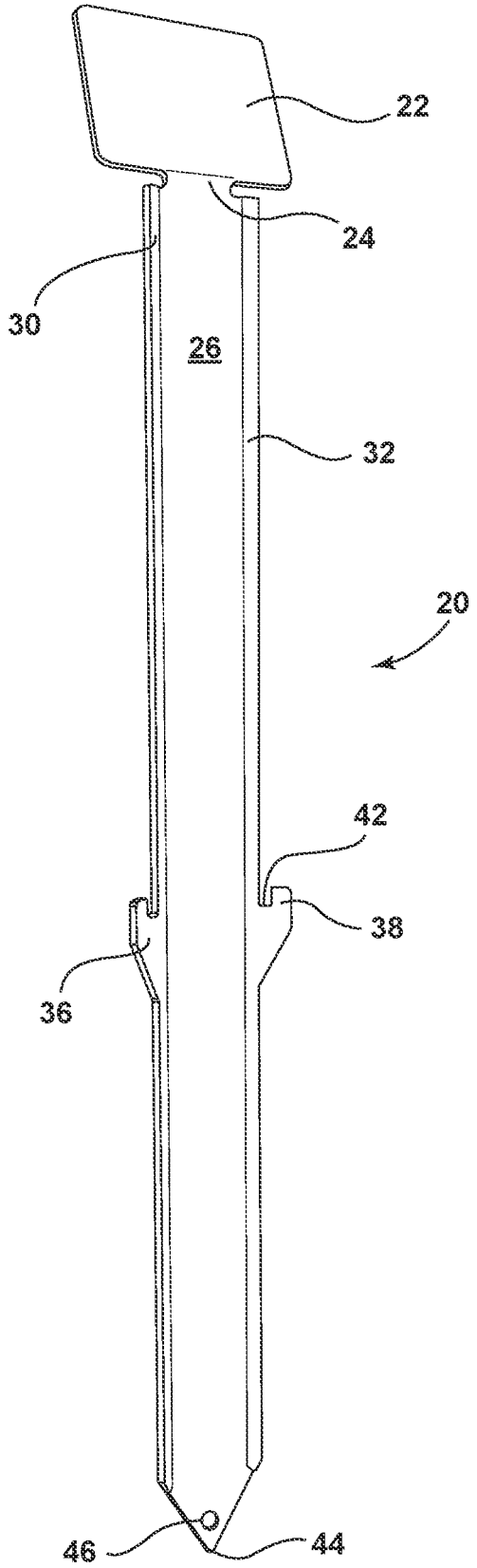
FIG. 1 is a first perspective view of a ground stake, including a face plate at a top end and first and second depth and installation tabs, according to some aspects.

FIGS. 1-4 illustrate a ground stake 20. In one arrangement, the ground stake is formed by a stamping machine from a metal material. The stamping machine cuts and folds the metal material into the elongate ground stake 20. The ground stake 20 shown in FIG. 1 includes a face plate 22 at a top end thereof. The face plate 22 is joined by a neck portion 24 to an elongate body 26 of the ground stake 20. The elongate body 26 includes a first or left bent edge 30 and a second right opposing bent edge 32 extending almost the entire length of the elongate body. The first left bent edge 30 and the second or right bent edge 32 as shown in FIGS. 1-4 strengthen and stabilize the ground stake 20 that has a thickness of 0.075 inches in one arrangement. In one arrangement, the thickness is of the left bent edge 30 and the right bent edge 32 is about 0.075 inches. Further, the views of FIGS. 1-4 show a front face or side of the planar elongate body 26 that is formed of cold rolled steel in one arrangement. The first bend edge 30 and the second bent edge 32 are a mirror image of each other projecting sidewardly and forwardly at a similar angle relative to a front face of the elongate body 26. In the arrangement of FIGS. 1-4, the first bent edge 30 and the second bent edge 32 are oriented parallel to each other along the length of the elongate body as the elongate body 26 generally has a constant width in the portion thereof shown in FIG. 3. Further, the first bent edge 30 and the second bent edge 32 are each formed as a rolled edge having a same radius value in one arrangement.

A first or left depth and installation tab 36 projects outwardly from the first bent edge 30. An opposing corresponding second or right depth and installation tab 38 projects outwardly from the second bent edge 32. The first depth and installation tab 36 is in a same plane as the first bent edge 30. The second depth and installation tab 38 is in the same plane as the send bent edge 32. The first depth and installation tab 36 includes an upwardly opening first or left slot 40 and the second depth and installation tab 38 includes an upwardly opening second or right slot 42 as shown in FIGS. 3 and 4.

The ground stake 20 further includes a tip 44 at the bottom end of the ground stake 20 for insertion in the ground. The tip 44 is triangular shaped as shown in FIGS. 1 and 4. The tip 44 is tapered in various other arrangements (not shown). The bottom end of the ground stake 20 also includes an aperture 46 in some arrangements. The first bent edge 30 and the second bent edge 32 extend the length of the elongate body 26, until the beginning of the triangular shaped tip 44 as shown in FIGS. 1 and 4.

Figure 2:
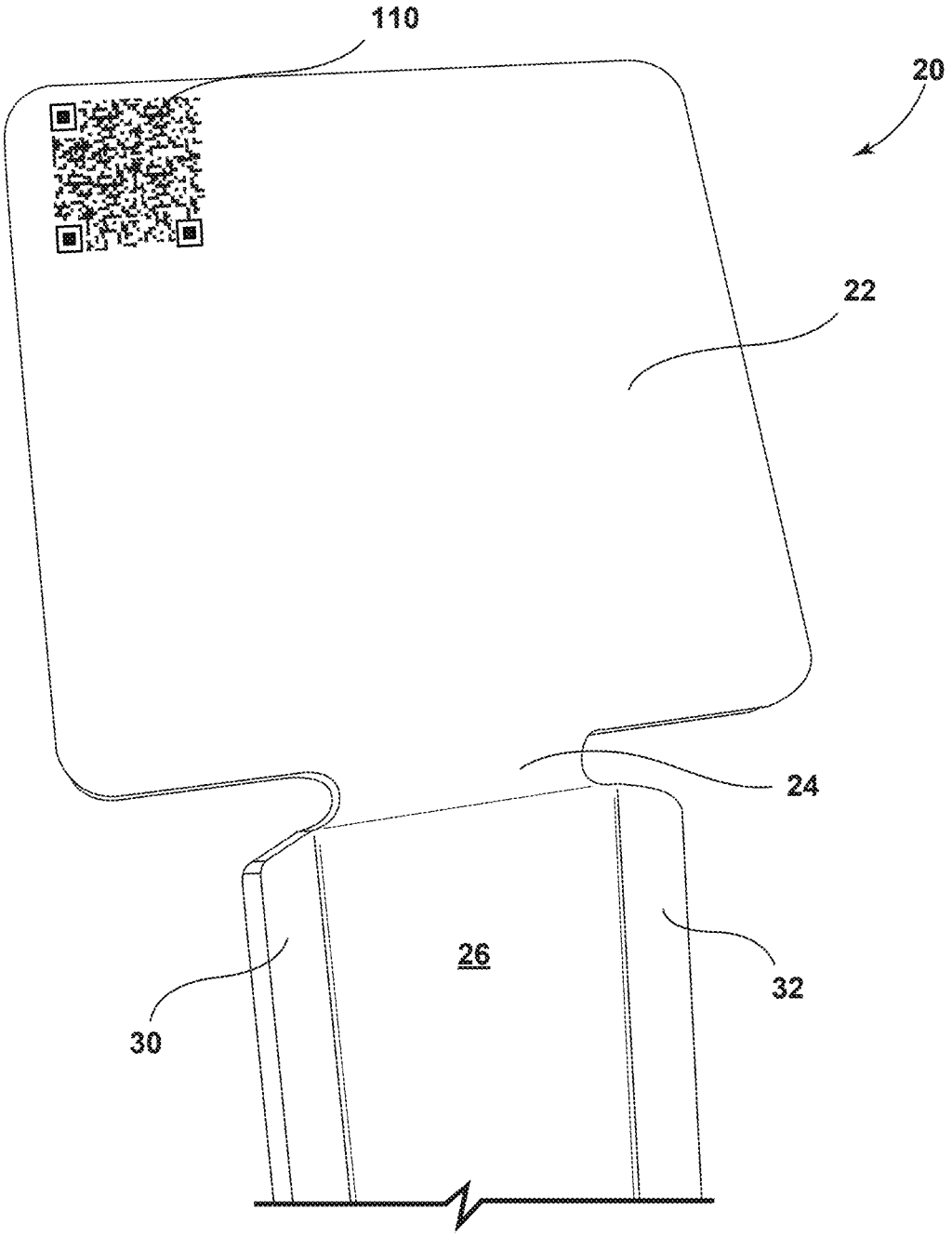
FIG. 2 is an expanded partial perspective view of the face plate at a top end of the ground stake of FIG. 1.

FIG. 2 shows a close up view of the face plate 22 and the narrow neck portion 24 joining the face plate 22 to a top end of the elongate body 26. The face plate 22 is oriented rearwardly from a front face of the elongate body 26 and the neck portion 24 at an angle of 30 degrees with respect to a vertical plane defined by the front face of the elongate body 26 in one arrangement. In other arrangements, the face plate 22 is a thin planar face plate oriented between or in a range from 15 degrees to 45 degrees with respect to the vertical plane defined by the front face of the elongate body 26. The angled face of the thin planar face plate 22 receives a QR code as a sticker or another element mounted thereon in some arrangements.

Figure 3:
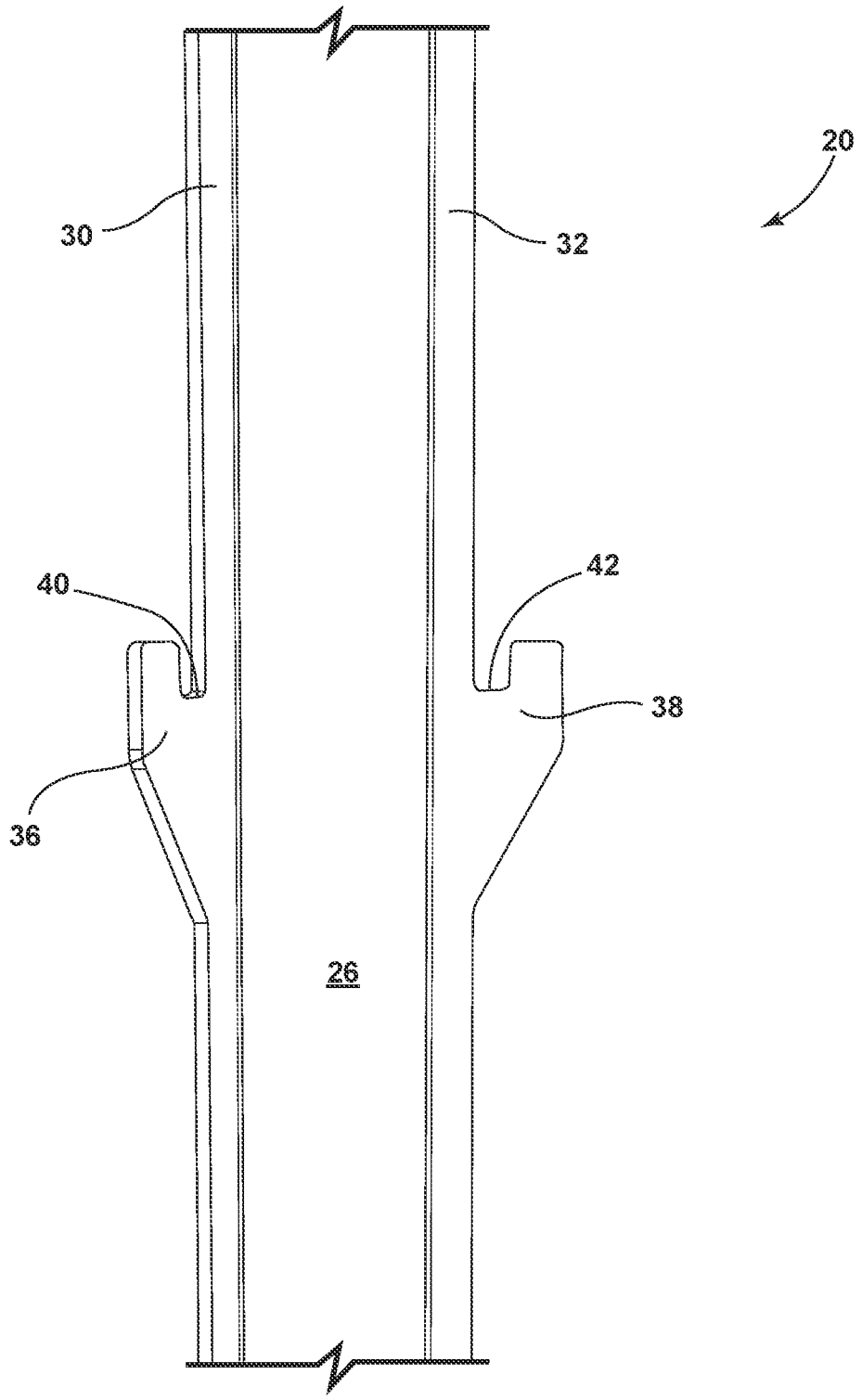
FIG. 3 is an expanded partial perspective view of the first and second depth and installation tabs and the first and second bent edges of the ground stake of FIG. 1.
Figure 4:
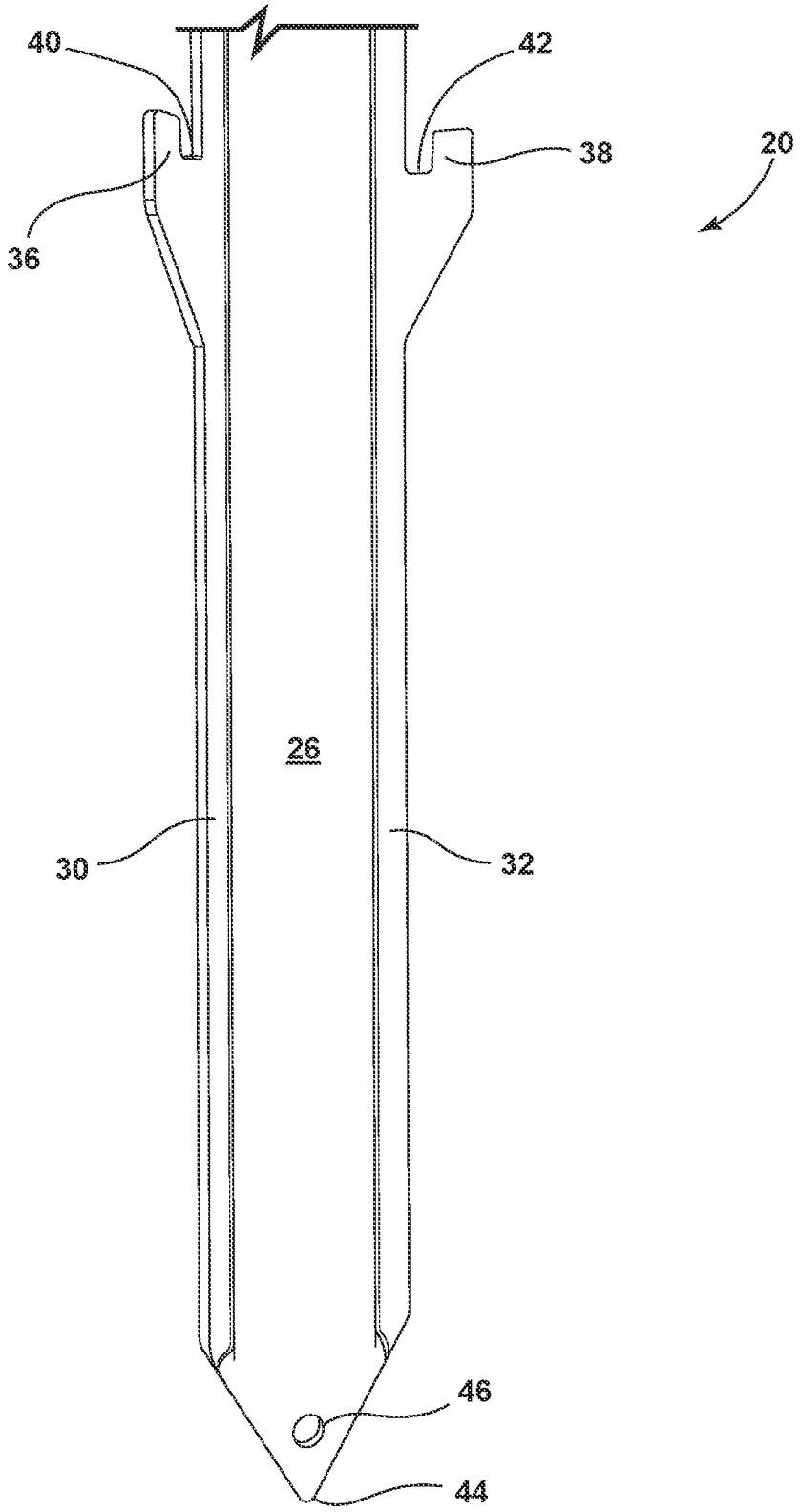
FIG. 4 is an expanded partial perspective view of a tip at a bottom end of the ground stake of FIG. 1.

FIG. 3 is a close up perspective view of a middle portion of the ground stake 20 that shows the first depth and installation tab 36 having a slot 40 and the second depth and installation tab having a slot 42. The first depth and installation tab 36 projects from the first bent edge 30 and is essentially planar therewith. Likewise, the second depth and installation tab 38 projects from the second bent edge 32 and is essentially planar therewith. The first depth and installation tab 36 is a mirror image of the second depth and installation tab 38. Thus, the first depth and installation tab projecting from the first bent edge and the second depth and installation tab projecting from the second bent edge form a mirror image as the size of the depth and installation tabs 36, 38 are the same and the opposing angles relative to the front face of the elongate body 26 are the same. The first depth and installation tab 36 and the first bend edge 30 are shown at an angle of about 45 degrees with respect to a plane defined by a flat surface of the elongate body 26. In some arrangements, the angle is between 35 degrees and 55 degrees. The first and second bent edges 30, 32 discontinue before or at the tip 44 at the bottom end of the elongate body 26, and in one arrangement when the elongate body begins to narrow to form the tip 44 for penetrating ground. In order to maintain strength and stability of the ground stake 20 during mounting thereof, the first and second bent edges 30, 32, are generally planar with the respective depth and installation tabs 36, 38.

The first slot 40 and the second slot 42 are aligned with each other transverse to a length of the planar elongate body 26. Thus, when the ground stake 20 is oriented vertically, the openings of the slots 40, 42 are oriented along or to form a horizontal path. The first and second slots 40, 42 are angled and sized to open in an upwardly oriented position for receiving a square nose shovel, square shovel, spade shovel or other tool. Even a round shovel is capable of simultaneously fitting into the first slot 40 and the second slot 42 depending on a size of the shovel head. Finally, a specialized tool having a handle and an opposing end with an edge that simultaneously fits in both of the first and second slots 40, 42, and avoids contact with a top end of the ground stake 20, is contemplated.

FIG. 4 shows an expanded front view of a bottom end of the ground stake 20. The bottom end of the ground stake 20 includes a generally triangular tip 44 for insertion into earth. In some arrangements the tip 44 is tapered instead of triangular shaped. In some arrangements, an aperture 46 is provided near the tip 44.

Insertion of Ground Stakes

In operation, the first and second depth and installation tabs 36, 38 are spaced so that a square nose shovel can be received simultaneously in both of the depth and installation tabs 36, 38 and downward force applied to drive or move the ground stake 20 into earth or ground. In use, the ground stakes 20 are driven downward by an application of force by a foot of an installer applied to a top of a shovel head until a bottom end of the shovel and the first and second depth and installation tabs 36, 38 are flush or close to flush with the earth. Thus, besides providing an arrangement to receive a shovel or tool that allows the ground stake 20 to be driven into the ground, the first and second depth and installation tabs 36, 38 act as a marker so that each of the ground stakes 20 penetrates into the ground approximately the same distance or to the same depth. In that way, the ground stakes 20 have a uniform appearance in a cemetery or other location as the ground stakes 20 penetrate or are driven into the ground at essentially the same distance for each stake.

Tag System

Figure 5:
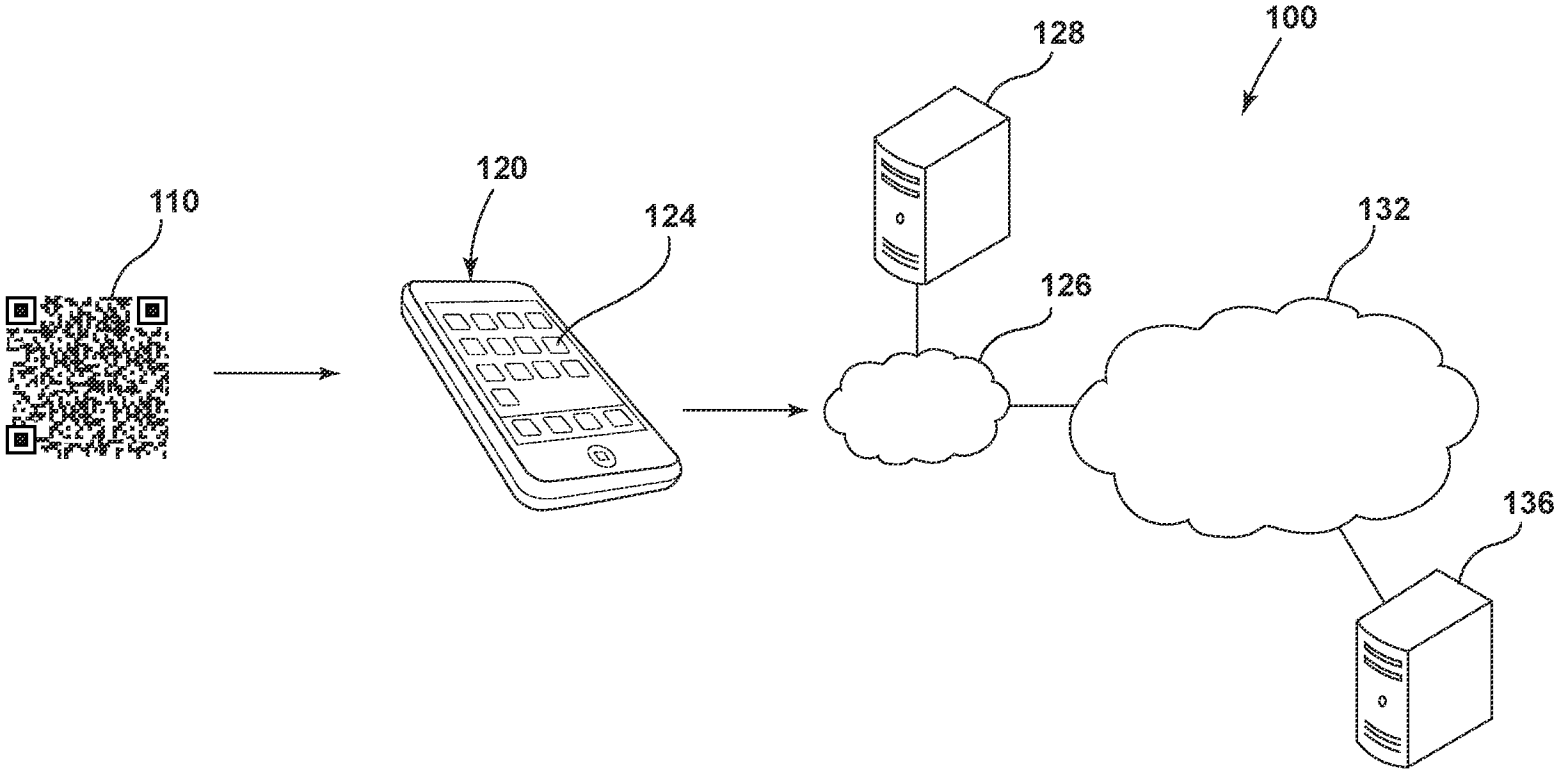
FIG. 5 illustrates a diagram of a tag system according to some aspects.

FIG. 5 shows a tag system 100 that includes a QR code 110 that is disposed on the face plate 22 of the ground stake 20. A tablet, smart phone 120 or other electronic user device is used for scanning the QR code 110. The tag system 100 includes a local network 126 that is connected to a computer or web server 128. The local network 126 is also connected to the internet 132 and to another computer or web server 136. The computers or web servers 128, 136 include one or more memories and one or more electronic processors (for example, a microprocessor, application specific integrated circuit, etc.) and an input interface, along with an output interface. The memory may include one or more non-transitory computer-readable media and includes at least a program storage area and a data storage area. The program storage area and the data storage area can include combinations of different types of memory, such as read-only memory ("ROM"), random access memory ("RAM"), electrically erasable programmable read-only memory ("EEPROM"), flash memory, or other suitable memory devices.

Operation-Group Stake

In operation, a user located near the ground stake 20 uses a tablet or smart phone 120 (sometimes referred to as an electronic user device) having a display 124 and a camera to scan an image of the QR code 110 disposed on the face plate 22. The smart phone 120 uses information in the QR code to link via a local network 126 to a web browser on a first web server 128 having a database with a list of deceased individuals corresponding to the QR code 110. The first web server 128 provides a selectable list of deceased individuals for the display 124 of the smart phone 120. Then, when a selection from the selectable list is made by a user of the smart phone 120, the first web server 128 transfers the web browser of smart phone 120 via the internet 132 to the second web server 136 hosting the "Find a Grave" website and obtains the information for the selected deceased individual therefrom. In an arrangement, the selection list corresponds to individual URLs on the "Find a Grave" ™ website. In one arrangement, the group of deceased individuals are life partners sharing a grave marker.

Operation-Individual Stake

In another operation, individual ground stakes 20 are provided for individual graves. In this situation, a user device scans the QR code 110 at the top of the ground stake 20 and opens a web browser on the web server 128 pointing to the web address embedded in the QR code. The web address includes a transmission protocol, such as https://, a domain of the website hosted on the first web server 128, and additional parameters that will be interpreted by the web server 128 to point to a specific web page.

The first web server 128 hosting the web site at that address loads the web site's default page, passing it the parameters, which may include a project number, and a specific tag, although other parameters are contemplated.

The code of the default web page reads those parameters, and the first web server 128 hosting a first web browser executes logic based on them, either to determine or look up an entry in a database which may contain another URL to redirect the user device to, or to construct a redirect URL based on predefined rules without needing to look for a database entry.

If a redirect URL was found for the specific parameters, the QR code will cause the first web browser to redirect to a second web server 136 to open to that specific web page, such as the "Find a Grave" website hosted on the second web server 136 that includes the webpage of the deceased individual. The process happens so quickly that the user does not know that a first web server 128 directed the display 124 of the tablet or smart phone 120 to the second web server 136.

If there was not a specific redirect entry found in the database based on the supplied parameters, a default redirect is used. In a first example above, the default page on a web browser hosted on the first web server 128 was the selection list of two or more deceased individuals corresponding to the QR code 110. Thereafter the user must input a selection from a selection list on a touch screen of the smart phone 120 to select one of the deceased individuals. In response to the selection, the first web server 128 redirects the smart phone 120 of the user to display the information for the deceased person from a web browser hosted by the second web server 136, such as "Find a Grave"™.

While disclosed above as using the tag system 100 to obtain information regarding a deceased person at grave sites, other arrangements are contemplated. For instance, the tag system 100 can be provided to obtain information regarding various outdoor views using ground stakes 20 with QR codes 110 disposed in national and local parks. The tag system 100 can be arranged to provide information regarding various animals and plants using ground stakes 20 having QR codes 110 that are disposed in zoos and botanical gardens. Many other uses are contemplated.

A local network 126, and an internet 132 are shown as separate elements in FIG. 5 for purposes of illustration. However, in some arrangements the local network 126 and the internet 132 may be considered a single world-wide network. Also, it should be understood that the illustrated components shown in FIG. 5, unless explicitly described to the contrary, may be combined or divided into separate software, firmware, and/or hardware. For example, instead of being located within and performed by a single electronic processor, logic and processing described herein may be distributed among multiple electronic processors or web servers. Similarly, one or more memory modules and communication channels or networks may be used even if examples described or illustrated herein have a single such device or element. Also, regardless of how they are combined or divided, hardware and software components may be located on the same computing device or may be distributed among multiple different devices. Accordingly, in this description and in the claims, if an apparatus, method, or system is claimed, for example, as including a controller, control unit, electronic processor, computing device, logic element, module, memory module, communication channel or network, or other element configured in a certain manner, for example, to perform multiple functions, the claim or claim element should be interpreted as meaning one or more of such elements where any one of the one or more elements is configured as claimed, for example, to make any one or more of the recited multiple functions, such that the one or more elements, as a set, perform the multiple functions collectively.

Moreover, in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing," or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," "contains . . . a" does not, without more constraints, preclude the existence of additional identical elements in the process, method, article, or apparatus that comprises, has, includes, contains the element. Unless the context of their usage unambiguously indicates otherwise, the articles "a," "an," and "the" should not be interpreted as meaning "one" or "only one." Rather these articles should be interpreted as meaning "at least one" or "one or more." Likewise, when the terms "the" or "said" are used to refer to a noun previously introduced by the indefinite article "a" or "an," "the" and "said" mean "at least one" or "one or more" unless the usage unambiguously indicates otherwise.

The terms "coupled," "coupling" or "connected" as used herein can have several different meanings depending on the context in which these terms are used. For example, the terms coupled, coupling, or connected can have a mechanical or electrical connotation. For example, as used herein, the terms coupled, coupling, or connected can indicate that two elements or devices are directly connected to one another or connected to one another through intermediate elements or devices via an electrical element, electrical signal or a mechanical element depending on the particular context.

Although certain arrangements, examples, features, and aspects have been described and illustrated, variations and modifications exist within the scope and spirit of the subject matter explained and shown.

What is claimed is:

1. A ground stake comprising:

an elongate body;

a face plate at a top end of the elongate body;

a first depth and installation tab projecting both sidewardly and forwardly from a first side of the elongate body, the first depth and installation tab including a first slot opening upwardly for receiving a tool to drive the ground stake into earth;

a second depth and installation tab projecting both sidewardly and forwardly from a second side of the elongate body, the second depth and installation tab including a second slot opening upwardly for receiving the tool to drive the ground stake into earth; and a tip at a bottom end of the elongate body for penetrating ground.

2. The ground stake of claim 1, wherein the elongate body is a planar elongate body having a front face, and wherein the first and second depth and installation tabs indicate that the ground stake is adequately driven into ground when the first and second depth and installation tabs contact or approach ground.

3. The ground stake of claim 2, including a first bent edge extending along the first side of the planar elongate body, and a second bent edge extending along a second side of the planar elongate body, wherein the first depth and installation tab projects outwardly from the first bent edge and the second depth and installation tab projects outwardly from the second bent edge.

4. The ground stake of claim 3, wherein the tool is adapted to be received in the first slot of the first depth and installation tab and is adapted to be received in the second slot of the second depth and installation tab opening in an upwardly oriented position so that a user applying a force to the tool drives can drive the ground stake into earth.

5. The ground stake of claim 3, wherein the first and second bent edges discontinue before or at the tip at the bottom end of the elongate body, and wherein the first and second bent edges stabilize the ground stake for application of force to the ground stake.

6. The ground stake of claim 3, wherein the first depth and installation tab projecting from the first bent edge and the second depth and installation tab projecting from the second bent edge form a mirror image.

7. The ground stake of claim 1, wherein the face plate at the top end of the ground stake is angled in a range from 15 degrees to 45 degrees rearwardly from a vertical plane defined by a front face of the elongate body, and wherein the face plate is a planar face plate.

8. The ground stake of claim 7, wherein the planar face plate at the top end of the ground stake is angled 30 degrees rearwardly from the vertical plane defined by the front face of the elongate body.

9. The ground stake of claim 2, wherein the first and second depth and installation tabs form a mirror image projecting from the planar elongate body, wherein the first and second depth and installation tabs and the first and second slots are aligned with each other transverse to a length of the planar elongate body.

10. The ground stake of claim 1, including a narrow neck portion joining the face plate to the elongate body.

11. The ground stake of claim 1, including a QR code provided on the face plate.

12. A tag system including the ground stake of claim 11, the tag system further including:

a first web server connected to a local network, and an electronic user device for scanning the QR code from the ground stake and linking to the first web server via the local network, wherein the first web server determines a specific web page from the QR code and directs the electronic user device to the specific web page.

13. The tag system of claim 12, wherein the first web server determines the specific web page by redirecting to a second web server and a display on the electronic user device displays the specific web page from a web browser hosted by the second web server.

14. The tag system of claim 13, wherein the specific web page displayed on the electronic user device includes information regarding a deceased person.

15. The tag system of claim 12, wherein the first web server provides a selection list as the specific web page that is displayed on a display on the electronic user device.

16. The tag system of claim 15, wherein in response to the electronic user device receiving a selection from the selection list displayed on the display, the first web server redirects to a second web server and the display of the electronic user device displays a specific web page from a web browser hosted by the second web server.

17. The tag system of claim 16, wherein the web page displayed on the electronic user device includes information regarding a deceased person.

18. The tag system of claim 15, wherein the electronic user device is a smart phone.

19. The tag system of claim 15, wherein the electronic user device is a tablet.

20. The tag system of claim 12, wherein the electronic user device is a smart phone.

* * * * *